US008671489B2

(12) United States Patent
Gallai et al.

(10) Patent No.: US 8,671,489 B2
(45) Date of Patent: Mar. 18, 2014

(54) DEVICE FOR BRIDGING AN EXPANSION JOINT

(75) Inventors: Gustav Gallai, Linz (AT); Georg Michael Wolff, Linz (AT); Erwin Detter, St. Valentin (AT)

(73) Assignee: Reisner & Wolff Engineering GmbH, Wels (AT)

( * ) Notice: Subject to any disclaimer, the term of this patent is extended or adjusted under 35 U.S.C. 154(b) by 0 days.

(21) Appl. No.: 13/498,932

(22) PCT Filed: Sep. 30, 2010

(86) PCT No.: PCT/AT2010/000359

§ 371 (c)(1),
(2), (4) Date: Jul. 10, 2012

(87) PCT Pub. No.: WO2011/038434

PCT Pub. Date: Apr. 7, 2011

(65) Prior Publication Data

US 2012/0308303 A1 Dec. 6, 2012

(30) Foreign Application Priority Data

Sep. 30, 2009 (AT) ..... A 1541/2009

(51) Int. Cl.
*E01C 11/02* (2006.01)
*E01D 19/06* (2006.01)

(52) U.S. Cl.
USPC ..... 14/73.1; 14/73.5; 404/68; 404/69; 52/393

(58) Field of Classification Search
USPC ..... 52/393, 396.05; 14/73.1, 73.5; 404/68, 404/69
See application file for complete search history.

(56) References Cited

U.S. PATENT DOCUMENTS

| | | | | | |
|---|---|---|---|---|---|
| 1,977,496 | A | * | 10/1934 | Snyder et al. | 52/393 |
| 3,520,236 | A | * | 7/1970 | Sequaris | 404/69 |
| 3,778,954 | A | * | 12/1973 | Meserole | 52/747.1 |
| 3,822,428 | A | * | 7/1974 | Stog et al. | 14/73.1 |
| 3,880,540 | A | * | 4/1975 | Rizza et al. | 404/69 |
| 4,319,855 | A | | 3/1982 | Huber et al. | |
| 4,968,178 | A | | 11/1990 | Köster et al. | |
| 5,205,100 | A | * | 4/1993 | Lecointre | 52/573.1 |
| 5,297,372 | A | * | 3/1994 | Nicholas | 52/396.07 |
| 5,649,784 | A | * | 7/1997 | Ricaud et al. | 404/47 |
| 5,791,111 | A | * | 8/1998 | Beenders | 52/396.05 |
| 6,561,728 | B1 | | 5/2003 | Seantier | |
| 6,668,412 | B1 | * | 12/2003 | Tadros et al. | 14/73.1 |
| 7,334,963 | B2 | * | 2/2008 | Costa et al. | 404/49 |
| 8,317,444 | B1 | * | 11/2012 | Hensley | 411/107 |

FOREIGN PATENT DOCUMENTS

| | | |
|---|---|---|
| CH | 691 496 | 7/2001 |
| DE | 11 84 368 | 12/1964 |
| DE | 25 20 791 | 3/1976 |
| DE | 28 42 171 | 6/1979 |

(Continued)

OTHER PUBLICATIONS

International Search Report of PCT/AT2010/000359, Apr. 5, 2012.

*Primary Examiner* — Gary Hartmann
(74) *Attorney, Agent, or Firm* — Collard & Roe, P.C.

(57) ABSTRACT

The invention relates to a device (1) for bridging an expansion joint (2) in the region of a carriageway, comprising a superstructure (5) and a substructure (6), and the superstructure (5) comprises at least one elastic element (15) and the substructure (6) forms a support for the superstructure (5). At least one holding element (19, 20) is disposed in the superstructure (5), which is at least partially embedded in the elastic element (15).

15 Claims, 2 Drawing Sheets

(56) References Cited

FOREIGN PATENT DOCUMENTS

| | | |
|---|---|---|
| DE | 32 25 304 | 2/1984 |
| DE | 37 39 717 | 3/1989 |
| EP | 0 086 277 | 8/1983 |
| EP | 0 512 460 | 11/1992 |
| FR | 1 380 667 | 12/1964 |
| FR | 2 442 299 | 6/1980 |
| GB | 1 318 805 | 5/1973 |
| GB | 2 124 673 | 2/1984 |
| GB | 2 162 559 | 2/1986 |
| WO | WO 99/52981 | 10/1999 |

* cited by examiner

DEVICE FOR BRIDGING AN EXPANSION JOINT

CROSS REFERENCE TO RELATED APPLICATIONS

This application is the National Stage of PCT/AT2010/000359 filed on Sep. 30, 2010, which claims priority under 35 U.S.C. §119 of Austrian Application No. A 1541/2009 filed on Sep. 30, 2009, the disclosure of which is incorporated by reference. The international application under PCT article 21(2) was not published in English.

BACKGROUND OF THE INVENTION

1. Field of the Invention

The invention relates to a device for bridging an expansion joint in the region of a carriage-way, comprising a superstructure and a substructure, and the superstructure comprises at least one elastic element and the substructure forms a support for the superstructure.

2 . Description of the Related Art

Structures of the generic type for bridging expansion joints between roads and bridge constructions are already known from the prior art.

For example, CH 691 496 A5 describes a connecting structure for expanding and/or contracting components comprising an elastic connecting layer provided with flexible reinforcing means secured to the components. The flexible reinforcing means may be provided in the form of at least one spring cast into the connecting layer, the ends of which are mounted on the respective components. The spring is a prestressed extension spring in particular. A wire mat may also be cast into the elastic connecting layer as a flexible reinforcing means. The elastic connecting layer is provided in the form of an expandable and contractable polymerized bitumen.

DE 32 25 304 C2 describes an overlay expansion joint in carriageways with an elastomeric expansion element accommodated in a water-tight arrangement in recesses of peripheral bodies of elastomeric concrete bounding the two sides of the joint, which are produced at the construction site by casting appropriate recesses of the carriageway so that they adjoin the carriageway flush with the carriageway. The expanding element is made from an elastomer corresponding to the elastomeric components of the peripheral bodies. This expanding element produced by casting between the peripheral bodies closes the joint between the peripheral bodies and is firmly adhered to them. In addition to the elastomeric components, the elastomeric concrete of the peripheral bodies contains added material in the form of a mineral granulate serving as a binding agent. The elastomer of the expanding element and the elastomeric components of the peripheral bodies may be a cold-setting polyurethane.

DE 37 39 717 C1 discloses a device for bridging expansion joints in carriageways, with a mat extruded from elastomeric material bridging the joint, the longitudinal edges of which parallel with the joint are respectively secured in a groove of a peripherally disposed profiled retaining section which is open at the top, for which purpose ribs are formed in the bottom face of the mat which locate in the groove in a form-fitting arrangement and essentially fill it with the exception of an anchoring space which is left free. The anchoring space is connected to the top face via orifices or slots in the mat serving as casting passages. The ribs are joined to the profiled retaining section by means of a cast body made from an elastomeric synthetic resin which fills the casting passages and anchoring space. The synthetic resin may be polyurethane, for example. The elastomeric mat itself is made from rubber.

An elastic overlay expansion joint made by COLAS GmbH, A-8101 Gratkorn, is known under the name of "Thorma® Joint" and comprises a mat structure made from bitumen with added polymer and a mineral supporting body of hard stone.

SUMMARY OF THE INVENTION

The objective of this invention is to propose an improved device for bridging an expansion joint in the region of a carriageway.

This objective is achieved by the device outlined above, in which at least one holding element is disposed in the superstructure, at least partially embedded in the elastic element. This reinforces the join between the superstructure and the substructure in the vertical region of the contact surface between the elastic element of the superstructure and the adjoining road covering so that this contact surface is relieved of load, thereby reducing scaling due to compressive or tensile stress. In the horizontal region, the at least one holding element improves the adhesion of the elastic element to the substructure. This improves the mechanical load-bearing capacity of the device, thereby resulting in a longer service life and reducing maintenance work and the associated costs.

Based on one embodiment of the invention, the holding element extends continuously at least approximately across the entire length of the superstructure. In other words, the holding element therefore extends at least approximately across the entire length of the expansion joint. Not only does this simplify construction of the device—the elastic element is preferably produced on site by casting as will be explained in more detail below—it also enables a further improvement to be obtained in terms of absorbing the forces acting on the expansion joint because these forces are spread over a larger surface within the elastic element and local differences in the load acting on the holding element and device are therefore eliminated or reduced.

Furthermore, the holding element(s) may have at least one recess into which the elastic element extends. This improves embedding of the holding element or holding elements in the elastic element, which in turn enables the mechanical stability of the device to be improved, in particular to prevent scaling.

Based on the preferred embodiment of the device, the elastic element of the superstructure is at least partially made from a castable synthetic resin or plastic, in particular a polyurethane or a polycarbamide or polyurea system. This on the one hand makes it easier to produce the device on site and on the other hand ensures that it can always be driven on, unlike bituminous systems, even at high climatic temperatures, for example in direct sunlight, at which bituminous systems already soften. Moreover, polyurethane or a polycarbamide or polyurea system is in particular more hardwearing than the systems based on bitumen known from the prior art. In particular, using a polyurethane or a polycarbamide or polyurea system means that the formation of track ridges, indentations and seepage of the surface can be better prevented. The polyurethane material or the polycarbamide or polyurea system can be incorporated cold within a broad temperature range. Conventional bituminous systems have to be incorporated hot, involving a considerable amount of energy and high noise emission. It is also possible to deal with, i.e. bridge, bigger expansion distances than in the past.

Particularly if using polyurethane or a polycarbamide or polyurea system to produce the elastic element, it is possible to make the layer thickness of the elastic element at most 60 mm. This makes this elastic element quite thin compared with asphalt expansion joints currently available on the market. The advantage of this reduction in the layer thickness is that deformation forces are lower. The deformation forces which occur due to changes in length of the support structure (tension/compression) on the one hand subject the adjoining components such as thrust bearings, support structure, bridge bearings, to loads, and on the other hand cause internal tensions in the material of the elastic element. The reduced layer thickness of the elastic element therefore enables the adjoining and subsequent components of the construction to be made smaller and more economically.

The substructure may be at least partially be made from a material from the group comprising epoxy resins, polymer concrete, concrete, metals, for example steel. This results in an inexpensive substructure offering the requisite properties in terms of rigidity for supporting the superstructure, i.e. in particular the elastic element.

It is preferable if the holding element(s) is or are connected to the substructure by means of at least one bonding anchor. As a result of this embodiment of the invention, the load-bearing capacity of the device is further increased because scaling in the region of the elastic element can be better prevented due to the fact that the holding element or holding elements are secured to the substructure, in other words the support structure. A better bonding effect is also achieved because the holding element or holding elements extend by their top face into the elastic element and the bonding anchor or anchors therefore also extend by its or their end into the elastic element, which helps to disperse the compression and tensile stress which occurs at the adhesion surface between the superstructure and the substructure.

Based on another embodiment, at least one shear key is provided on the elastic element on a bottom face pointing in the direction towards the substructure and extending continuously at least approximately across the entire length of the superstructure. This firstly provides a mechanical connection between the elastic element and the substructure, thereby relieving the contact surface between the superstructure, i.e. the elastic element, and the substructure of shearing stress. Secondly, this contact surface is made larger as a result, thereby enabling static stress to be reduced.

At least one stabilizer element may be disposed in the elastic element. This ensures that the elastic element is able to absorb expansion or shifting distances that are substantially bigger than those which can be absorbed by simple, elastic overlay expansion joints made from bituminous materials.

Based on another embodiment, the stabilizer element or stabilizer elements of the device may have a sleeve-shaped element or sleeve-shaped elements in which the stabilizer element or stabilizer elements are disposed. The sleeve-shaped element or sleeve-shaped elements act as shear sleeves in which the stabilizer element or stabilizer elements are guided and in which they are able to move, thereby improving the effect of the stabilizer elements in terms of imparting reinforcement to the elastic element of the superstructure.

The stabilizer element(s) is or are preferably supported on the holding element or on the holding elements, thereby enabling the stability of the expansion joint to be improved by means of these stabilizer elements and the preferably rigid holding elements.

Based on one particular embodiment, the holding element(s) are provided in the form of an angle section or angle sections for this purpose, and arms are therefore provided on this holding element or on these holding elements which extend into the elastic element and are thus able to improve adhesion of the holding element or holding elements on the elastic element, which in turn enables higher forces to be transmitted.

In this case, it is of advantage if the stabilizer element(s) extends or extend between the upwardly projecting arms of the angle sections, i.e. the arms of the angle sections extending into the elastic element, in particular lie against these arms, thereby further improving the stabilizing function due to the co-operation of the stabilizer elements with the holding element or holding elements.

The stabilizer element(s) may also have a compression spring in order to prevent the stabilizer elements from slipping out of the elastic element.

Based on another embodiment, the stabilizer element(s) or the sleeve-shaped element(s) is or are at least partially surrounded by a spiral hose. In particular, the latter is cast in the elastic element and causes expansions to be uniformly transmitted to the stabilizer element or stabilizer elements. This also prevents or reduces friction with the elastic element, in other words the polyurethane cast for example.

BRIEF DESCRIPTION OF THE DRAWINGS

To provide a clearer understanding, the invention will be described in more detail with reference to the appended drawings.

These are schematically simplified diagrams illustrating the following.

DETAILED DESCRIPTION OF THE PREFERRED EMBODIMENTS

Figure 1:
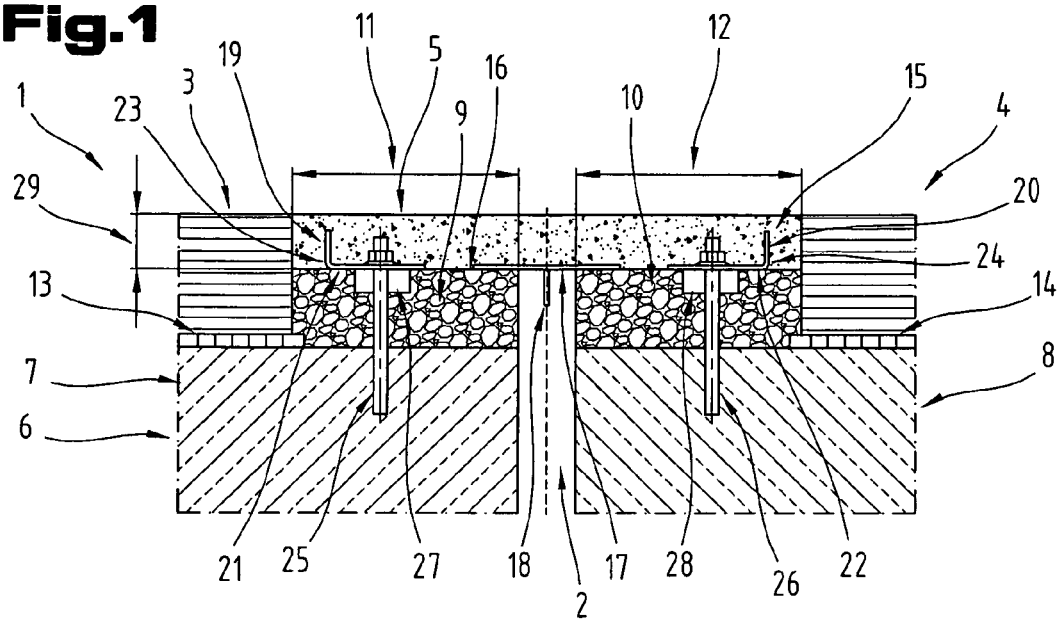
FIG. 1 is a side view in section illustrating a first embodiment of a device proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIG. 1 illustrates a device 1 for bridging an expansion joint 2 between a carriageway 3 and a bridge adjoining this carriageway 4, in particular a road bridge.

The device 1 has a superstructure 5 and a substructure 6.

The substructure 6 in this embodiment comprises two base elements 7, 8 spaced apart from one another, which extend into the region of the expansion joint 2. Disposed on these base elements 7, 8, in particular connected to the base elements 7 respectively 8, is a respective substructure sole piece 9, 10.

The base elements 7, 8 may be made from concrete, of the type used in road construction, for example.

The two substructure sole pieces 9, 10 are disposed between the carriageways 3, 4 in the expansion joint 2 and in particular may be made from an epoxy resin or a polymer concrete or some other appropriate, rigid building material. In particular, it also possible for these two substructure sole pieces 9, 10 to be produced in situ on the construction site if prefabricated elements are not used for this purpose.

The substructure 6 is of a rigid design relative to the superstructure 5. The term "rigid" in the context of the invention is intended to mean that this substructure 6 and its components do not undergo any change in dimensions during operation of the device 1 other than due to thermal expansion and contraction.

The two substructure sole pieces 9, 10 preferably have a width 11, 12 which is dimensioned so that a gap formed by the spaced apart arrangement of the two base elements 7, 8 relative to one another does not undergo a pinching effect, in other words the mutually facing end faces of the substructure sole pieces 9, 10 are preferably each arranged flush with the respective end faces of the two mutually facing base elements 7, 8 as illustrated in FIG. 1.

In the region adjoining the expansion joint 2 and extending to a certain degree into the expansion joint 2, a seal element 13, 14, for example a sealing film of the type known from the prior art, is disposed between the carriageways 3, 4 and the base elements 7, 8.

The superstructure 5 comprises an elastic element 15, which extends in a bridging arrangement between the two carriageways 3, 4 and the expansion joint 2. In particular, this elastic element is disposed on the top face flush with the surfaces of the carriageways 3, 4 so that there is no raised area or indentation on the road surface in the region of the expansion joint 2 which might otherwise influence driving comfort.

The elastic element 15 is supported on the substructure sole pieces 9, 10. Since the elastic element 15 is produced by a casting process from a synthetic resin or plastic, and preferably is so directly at the construction site, it is possible for the material of the elastic element 15 to bind, at least in those areas where this elastic element 15 lies directly on the substructure sole pieces 9, 10 forming a contact surface 16.

A cold-setting, castable synthetic resin or a cold-setting, castable plastic is preferably used for the elastic element 15, in particular a polyurethane or a polycarbamide or polyurea system, to enable the elastic element 15 to be produced by casting directly at the construction site. The polyurethane or polycarbamide or polyurea system used is a polyurethane or a polycarbamide or polyurea system with a hardness adapted to the application, on the one hand to permit deformation with the least resistance possible and on the other hand to ensure that the loads created by traffic causes the least deformation possible. For example, a 2K-polyurea system may be used. The polyurethane or the polycarbamide or polyurea system may have a Shore A hardness of 55 to 85. The tensile strength of the polyurethane or the polycarbamide or polyurea system based on DIN 53504 may be between 10 and 30 $N/mm^2$. The polyurethane or the polycarbamide or polyurea system may also have an expansion based on DIN 53504 of between 400 and 1200%. It is of particular advantage to use a polyurethane or a polycarbamide or polyurea system with thixotropic properties and with a viscosity at 23° C. of between 4000 and 6000 mPas.

To improve adhesive capacity, an adhesion-imparting agent or so-called primer may also be used beforehand.

In the region of the gap formed in the horizontal direction between the substructure sole pieces 9, 10 and base elements 7, 8, a cover element 17 is placed on the substructure sole pieces 9, 10, which covers this gap, in particular to seal it against moisture. This cover element 17 may be made from a metal or may be a plastic strip, for example. By preference, the cover element 17 has a centering element 18 so that his cover element 17 can be more accurately fitted and with a view to increasing the operating safety of the device 1, and the centering element 18 extends into the gap between the two base elements 7, 8 and the substructure sole pieces 9, 10.

In order to improve the join between the elastic element 15 and the substructure sole pieces 9, 10 in the case of the embodiment illustrated in FIG. 1, two holding elements 19, 20 are disposed in the region of the contact surface 16. Accordingly, the two holding elements 19, 20 are embedded in at least the surface extending in the direction towards the elastic element 15.

The holding elements 19, 20 are preferably provided in the form of angle elements with a base 21, 22 and arms 23, 24 extending upwards from the base 21, 22 at least approximately at a right angle into the elastic element 15 and embedded in it. The two arms 23, 24 are preferably directed towards the carriageways 3, 4 in each case, as illustrated.

The holding elements 19, 20 are preferably made from a metal, for example steel.

In order to improve the join between the elastic element 15 and the holding elements 19, 20, the latter may be provided with at least one recess, in which case they are preferably made from perforated sheet metal or perforated sheeting to allow the castable, curable synthetic resin or plastic to penetrate these recesses during the process of producing the elastic element 15.

Figure 4:
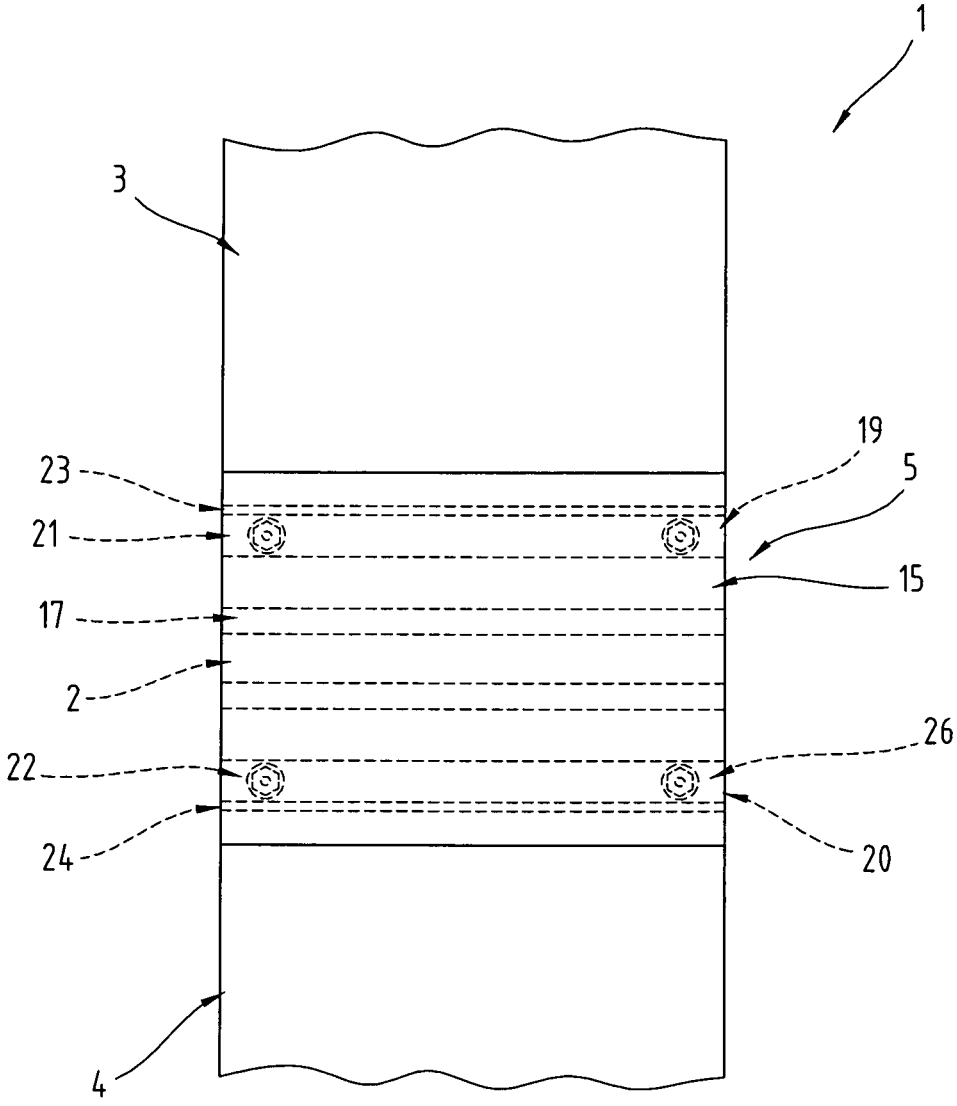
FIG. 4 is a partial plan view illustrating the holding elements extending the entire length of the expansion joint in a device proposed by the invention.

In the preferred embodiment, the two holding elements 19, 20 extend across the entire length of the expansion joint 2, which extends in the direction from which the embodiment illustrated in FIG. 1 is viewed in the drawing. See FIG. 4. However, it would also be possible to provide several individual holding elements 19, 20 next to one another in the direction of the length. Another option is to use only a single holding element 19 which lies on both the substructure sole pieces 9, 10 and is disposed so that it bridges the gap. In this case, it is of advantage if this single holding element 19 has at least one elastic region, for example in the region of the gap, between the substructure sole pieces 9, 10 and the base elements 7, 8 to permit expansion and contraction of the device 1 due to changes in the dimensions of the carriageway 3, 4 and the road and bridge caused by changes in temperature. To this end, this holding element 19 may be made up of several parts with an elastic intermediate piece and it is also possible to permit this expansion and contraction on the basis of the geometric design of the holding element 19. To this end, this holding element 19 may be of a zigzag shape or accordion shape, etc., in particular in the region of the gap.

In order to improve the join between the holding elements 19, 20 and the substructure 6, the holding elements 19, 20 may each be provided with at least one bonding anchor 25, 26, in which case these bonding anchors 25, 26 extend out from the elastic element 15 at least as far as the region of the substructure sole pieces 9 respectively 10, preferably into the region of the base elements 7 respectively 8 , as illustrated in FIG. 1. In particular, these bonding anchors 25, 26 may be retained by an appropriate dowel in the substructure sole piece 9, 10 and/or the base element 7, 8. Another option would be for these bonding anchors 25, 26 to be concreted into the base element 7, 8 or into the substructure sole pieces 9, 10 already. The top ends of the bonding anchors extending into in the elastic element 15 are embedded during the process of producing the elastic element 15 from the synthetic resin or plastic when the expansion joint 2 is being cast.

Although it is possible to provide only one bonding anchor 25, 26 for each side of the expansion joint 2, it is preferable for the purposes of the invention to provide several such bonding anchors 25, 26 next to one another in the longitudinal direction of the expansion joint and preferably arranged at regular intervals from one another.

In the case of the embodiment where several holding elements 19, 20 are arranged next to one another in the direction of the longitudinal extension of the expansion joint 2, each of these holding elements 19, 20 is preferably provided with a separate bonding anchor 25, 26.

The bonding anchors 25, 26 are preferably made from a metal, in particular steel.

Based on another embodiment of the invention, the elastic element 15 is provided with at least one shear key 27 respectively on either side of the expansion joint 2, in other words on each side in the region next to the gap formed between the substructure sole pieces 9, 10 and base elements 7, 8. These two shear keys 27, 28 are produced when the elastic element 15 is being produced by filling the expansion joint 2 with the synthetic resin or plastic, for which purpose appropriate groove-type ridges are provided in the substructure sole pieces 9, 10 to enable the synthetic resin or plastic to run out of and penetrate these grooves. This enables these shear keys 27, 28 to be made integrally with the elastic element 15. Penetration by of the grooves in the substructure sole pieces 9, 10 by the synthetic resin or plastic is made possible by the recesses in the holding elements 19, 20.

Within the scope of the invention, however, it would also be possible to provide several such shear keys 27, 28 one after the other within one of the substructure sole pieces 9, 10 in the direction of travel.

These shear keys 27, 28 preferably extending continuously across the entire length of the expansion joint 2 and elastic element 15, although it would also be possible to provide several such shear keys 27, 28 next to one another in the direction of the length of the expansion joint 2.

Furthermore, the shear keys 27, 28 may have a rectangular cross-section as viewed in the direction of the length of the expansion joint 2 and the cross-sections of the groove-shaped ridges may likewise have at least one undercut, thereby resulting in a better join because the synthetic resin or plastic is able to fill this undercut. However, the shear keys 27, 28 may also have square or polygonal cross-sections, etc.

Figure 2:
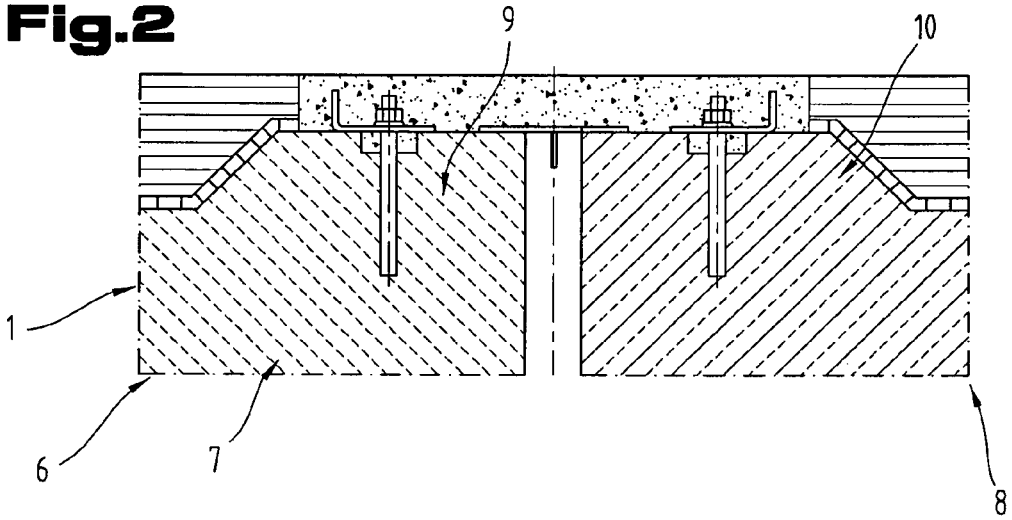
FIG. 2 is a side view in section illustrating another embodiment of the device.

FIG. 2 illustrates an embodiment of the device 1 proposed by the invention. This embodiment of the device 1 illustrated in FIG. 2 is essentially the same as that illustrated in FIG. 1 except that a respective base element 7, 8 is of an integral design with one of the substructure sole pieces 9, 10 respectively. For example, these elements of the substructure 6 may be made from a construction concrete or similar and produced by casting.

Reference may be made to the explanations given in connection with FIG. 1 for further details of this embodiment of the invention to avoid unnecessary repetition.

The elastic element 15 preferably has a layer thickness 29 (FIG. 1) of at most 60 mm, in particular at most 50 mm.

Figure 3:
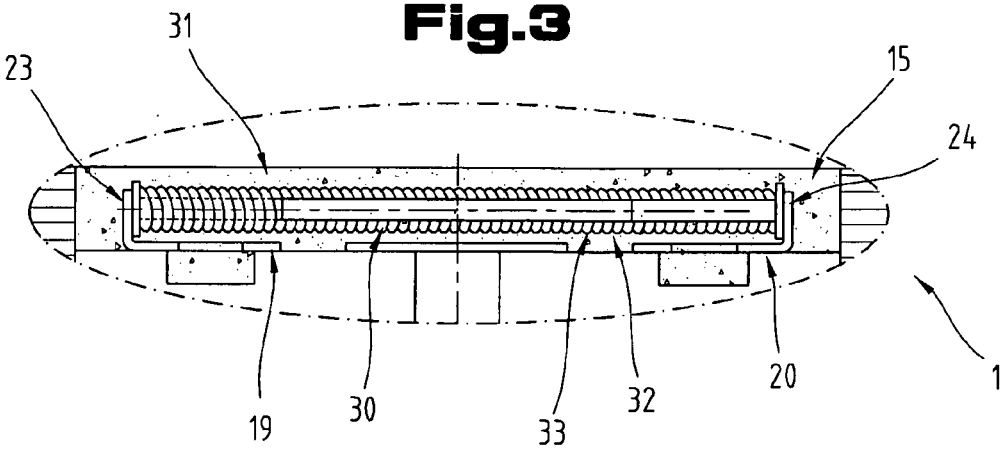
FIG. 3 shows a detail of a device proposed by the invention in the region of a stabilizer element

FIG. 3 illustrates a detail of an embodiment of the device 1. Within the scope of the invention, it is possible to provide at least one stabilizer element 30 in the elastic element 15. For example, this stabilizer element 30, and preferably several such stabilizer elements 30, made from a round steel are distributed across the length of the expansion joint 2. It would also be possible to use other geometric rod shapes. These stabilizer elements 30 reinforce the elastic element 15 and thus improve its mechanical properties. The stabilizer element 30 or the stabilizer elements 30 is or are supported in the holding element(s) 19, 20 based on the preferred embodiment. In particular, they are supported on the two arms 23, 24 of the holding elements 19, 20, as illustrated in FIG. 3. Nuts and washers (not illustrated) may also be provided on the ends facing the two arms 23, 24 of the holding elements 19, 20 in order to pre-tension the stabilizer elements 30 between the two arms 23, 24. It would also be possible to fit a compression spring 30, for example a helical spring, across at least a part of the stabilizer elements 30 in order to prevent the stabilizer elements from slipping out of the cast of the elastic element 15. In the preferred embodiment, the stabilizer elements 30 are not embedded directly in the elastic element 15 and instead, these stabilizer elements 30 are guided in a sleeve-shaped element 32 which surrounds a stabilizer element 30 respectively in the radial direction.

It is also possible to dispose several stabilizer elements 30 in one sleeve-shaped element 32, although this is not the preferred embodiment because volume for forming the elastic element 15 is lost as a result.

In order to prevent friction between the elastic element 15, for example on the polyurethane cast, instead of just the sleeve-shaped elements 32, it is possible to provide a spiral hose 33 surrounding them in addition, for example made from plastic, which is cast into the elastic element 15 when it is being produced. This also enables the expansion to be transmitted uniformly to the stabilizer elements 30.

The embodiments illustrated as examples represent possible variants of the device 1, and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

For the sake of good order, finally, it should be pointed out that, in order to provide a clearer understanding of the structure of the part-feeding system, it and its constituent parts are illustrated to a certain extent out of scale and/or on an enlarged scale and/or on a reduced scale.

LIST OF REFERENCE NUMBERS

1 Device
2 Expansion joint
3 Carriageway
4 Carriageway
5 Superstructure
6 Substructure
7 Base element
8 Base element
9 Substructure sole piece
10 Substructure sole piece
11 Width
12 Width
13 Seal element
14 Seal element
15 Element
16 Contact surface
17 Cover element
18 Centering element
19 Holding element
20 Holding element
21 Base
22 Base
23 Arm
24 Arm
25 Bonding anchor
26 Bonding anchor
27 Shear key
28 Shear key

29 Layer thickness
30 Stabilizer element
31 Compression spring
32 Element
33 Spiral hose

The invention claimed is:

1. A device for bridging an expansion joint in the region of a carriageway, comprising a superstructure and a substructure forming a support for the superstructure, wherein the superstructure comprises at least one elastic element at least partially made from a castable synthetic resin or a castable plastic and at least one shear key provided on a bottom face of the at least one elastic element pointing towards the substructure and made integrally with the at least one elastic element, wherein at least one holding element is disposed in the superstructure which is at least partially embedded in the elastic element.

2. The device according to claim 1, wherein the holding element extends continuously across at least approximately the entire length of the superstructure.

3. The device according to claim 1, wherein the at least one holding element has at least one recess into which the elastic element extends.

4. The device according to claim 1, wherein the elastic element of the superstructure is at least partially made from a polyurethane or a polycarbamide or polyurea system.

5. The device according to claim 1, wherein the elastic element has a layer thickness of at most 60 mm.

6. The device according to claim 1, wherein the substructure is made at least partially from at least one material from the group consisting of epoxy resins, polymer concrete, concrete, and steel.

7. The device according to claim 1, wherein the at least one holding element is connected to the substructure via at least one bonding anchor.

8. The device according to claim 1, wherein the at least one shear key extends continuously across at least approximately the entire length of the superstructure

9. The device according to claim 1, wherein at least one stabilizer element is disposed in the elastic element.

10. The device according to claim 9, wherein the at least one stabilizer element is disposed in at least one sleeve-shaped element.

11. The device according to claim 9, wherein the at least one stabilizer element is supported on the at least one holding element.

12. The device according to claim 1, wherein the at least one holding element is provided in the form of an angle section or angle sections.

13. The device according to claim 12, wherein at least one stabilizer element extends between upwardly projecting arms of the angle sections.

14. The device according to claim 9, wherein the at least one stabilizer has a compression spring.

15. . The device according to claim 10, wherein the at least one stabilizer element or the at least one sleeve-shaped element is at least partially surrounded by a spiral hose.

* * * * *

UNITED STATES PATENT AND TRADEMARK OFFICE

CERTIFICATE OF CORRECTION

PATENT NO. : 8,671,489 B2
APPLICATION NO. : 13/498932
DATED : March 18, 2014
INVENTOR(S) : Gallai et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 62 days.

Signed and Sealed this
Twenty-ninth Day of September, 2015

Michelle K. Lee

Michelle K. Lee
*Director of the United States Patent and Trademark Office*